US009944109B2

(12) United States Patent
Nijssen et al.

(10) Patent No.: US 9,944,109 B2
(45) Date of Patent: Apr. 17, 2018

(54) IDENTIFICATION ASSEMBLY FOR AN IDENTITY DOCUMENT

(71) Applicant: MORPHO B.V., Haarlem (NL)

(72) Inventors: Cornelis Gerardus Maria Nijssen, Hoom (NL); Jan Van Den Berg, Gouda (NL)

(73) Assignee: MORPHO B.V., Haarlem (NL)

( * ) Notice: Subject to any disclaimer, the term of this patent is extended or adjusted under 35 U.S.C. 154(b) by 229 days.

(21) Appl. No.: 14/910,070

(22) PCT Filed: Jul. 23, 2014

(86) PCT No.: PCT/NL2014/050502

§ 371 (c)(1),
(2) Date: Feb. 4, 2016

(87) PCT Pub. No.: WO2015/030575

PCT Pub. Date: Mar. 5, 2015

(65) Prior Publication Data

US 2016/0176219 A1 Jun. 23, 2016

(30) Foreign Application Priority Data

Aug. 29, 2013 (NL) ..... 2011352

(51) Int. Cl.
*B42D 25/24* (2014.01)
*B42D 25/351* (2014.01)
(Continued)

(52) U.S. Cl.
CPC ..... *B42D 25/309* (2014.10); *B42D 25/24* (2014.10); *B42D 25/346* (2014.10);
(Continued)

(58) Field of Classification Search
CPC .... B42D 25/24; B42D 25/346; B42D 25/351; B42D 25/435
(Continued)

(56) References Cited

U.S. PATENT DOCUMENTS

2007/0229263 A1* 10/2007 Staub ..... B42D 25/342 340/572.1
2008/0169638 A1 7/2008 Beyer-Meklenburg et al.
(Continued)

FOREIGN PATENT DOCUMENTS

DE 10 2004 048361 A1 4/2006
DE 10 2004 055495 A1 5/2006
(Continued)

OTHER PUBLICATIONS

International Search Report, dated Oct. 8, 2014, from corresponding PCT application.

*Primary Examiner* — Kyle Grabowski
(74) *Attorney, Agent, or Firm* — Young & Thompson

(57) ABSTRACT

An identification assembly for an identity document (10) includes a substrate (12) with a substantially planar configuration, and an adjacent surface (13, 14) hingeably attached to the substrate (12) and provided adjacent to the substrate (12). The substrate (12) includes at least two image areas (18, 20), a first image area (18) having a first image (19), and wherein the substrate includes a second image area (20) including a second laser produced image (21), and a third image (22) corresponding to the second image (21) is provided through the second image area (20) onto the adjacent surface (13, 14), the third image (22) being visible for a user by hinging the substrate away from the adjacent surface (14).

3 Claims, 4 Drawing Sheets

(51) Int. Cl.

| | |
|---|---|
| ***B42D 25/435*** | (2014.01) |
| ***B42D 25/346*** | (2014.01) |
| ***B42D 25/309*** | (2014.01) |
| ***B42D 25/41*** | (2014.01) |
| ***B42D 25/373*** | (2014.01) |

(52) U.S. Cl.
CPC ..... *B42D 25/351* (2014.10); *B42D 25/373* (2014.10); *B42D 25/41* (2014.10); *B42D 25/435* (2014.10)

(58) Field of Classification Search
USPC ..... 283/77
See application file for complete search history.

(56) References Cited

U.S. PATENT DOCUMENTS

| | | | | |
|---|---|---|---|---|
| 2011/0037247 | A1* | 2/2011 | Tappij-Gielen ..... | B42D 25/435<br>283/77 |
| 2011/0298205 | A1* | 12/2011 | Pohjola ..... | B42D 25/351<br>283/75 |
| 2012/0176652 | A1* | 7/2012 | Green ..... | B42D 25/346<br>358/3.28 |
| 2015/0129780 | A1* | 5/2015 | Le Loarer ..... | B42D 25/24<br>283/113 |

FOREIGN PATENT DOCUMENTS

| | | | | |
|---|---|---|---|---|
| EP | 1 516 749 | A2 | 3/2005 | |
| EP | 2559563 | A1 * | 2/2013 | ..... B42D 25/45 |
| FR | 2 918 311 | A1 | 1/2009 | |
| FR | 2 975 945 | A1 | 12/2012 | |

* cited by examiner

IDENTIFICATION ASSEMBLY FOR AN IDENTITY DOCUMENT

FIELD OF THE INVENTION

The present invention relates to an identification assembly for an identity document comprising a substrate with a substantially planar configuration, and an adjacent surface hingeably attached to the substrate and provided adjacent to the substrate, wherein the substrate comprises at least two image areas, a first image area having a first image.

BACKGROUND OF THE INVENTION

In general, identity documents such as passports having a substrate which comprises two image areas, having in each of these image areas a laser engraved image corresponding to the holder of the identity document, are known in the art.

In FR2975945, an identity document is shown, wherein the identity document comprises two image areas, having a first laser engraved image of a person in a first area, while a second image area is provided with a transparent window in which a second image of the person is laser engraved. Additionally, the window is provided with a security feature of variable data of the ID holder, which extends over said window. The image in the window is visible from front and rear sides of the identity document. Moreover, an holographic mark is disposed in the transparent area to provide an extra security feature making its fraudulent use and reproduction more difficult.

A Swedish passport comprising the features of the preamble of claim 1 is known in the art forming an identity document having a transparent window. This passport comprises a page with the holder data and images, hereafter referred as a holder page, having a first and a second image in a same plane in a polycarbonate substrate. In addition, these images are repeated as a perforation pattern in another area of the substrate. Moreover, the Swedish passport further comprises a transparent window having a lens structure, allowing an inspecting person to inspect any underlying adjacent page of the passport document including an image having invisible security data that can be viewed via the lens structure of the window. Viewing the underlying image through the lens allows viewing invisible data information by the inspecting person.

Moreover, in EP 1516749 an identity document is disclosed comprising a cover, a personalized sheet comprising a laser personalization item such as a picture of the identification holder and a number of personalized data, and a number of inner pages comprising a laser-produced identification number. The cover, the personalized sheet and the inner pages are hingeably connected at a folding seam area.

The known security documents have as a disadvantage that the holder pages can be subjected to complete replacement or change-out of said page, without leaving easily detectable traces of such unauthorised replacement of the original holder page, due to the fact that all the features presented in the holder page, are exchanged in their entirely.

Moreover, the prior art identity documents do not present any features that allow the inspecting person an easy way of verifying the authenticity of the holder page in the presented document without making an additional inspection of said document by means of tilting the identity document in such a way that the data presented in the holographic mark can be seen, or putting the identity document against a light in order to check that the holographic mark presented is the original holographic mark or that the other identity features presented are authentic.

It is therefore an object of the present invention to at least overcome one of the above mentioned disadvantages of the prior art. It is also an object of the present invention is to provide an identification assembly for an identity document that makes the unauthorised or fraudulent use or replacement of the holder page more difficult by providing a direct link between the holder page and different parts of the identity document.

It is also an object of the present invention to provide an identity document in which the correspondence between the holder page and the identity document can be easily detected by an inspecting person.

It is furthermore an objective of the present invention to provide a method of manufacturing an identity document in which the authenticity between a holder page and the document can easily be established.

SUMMARY OF THE INVENTION

These objects are achieved by providing an identity document of the type described above wherein the substrate comprises a second image area comprising a second laser produced image, and wherein a third image corresponding to the second image is provided through the second image area onto the adjacent surface, the third image being visible for a user by hinging the substrate away from the adjacent surface.

It should be noted that the second laser produced image can be engraved, perforated or ablated in the second image area of the substrate.

By having the third image applied onto the adjacent surface through the second image area in the substrate, a further identification feature is provided which makes it more difficult to exchange the substrate part from the identity document and at the same time allows easier inspection by a user and/or an inspecting person, without the need of putting the identity document against a light, because by simply lifting the substrate in order to inspect the third image in the underlying or overlying adjacent surface, the authenticity of the identification document can be examined in an easy and reliable manner. In this way, unauthorised exchange of the holder page becomes more difficult than if only images were provided onto the holder page in the identity document.

In an embodiment of the invention, the substrate comprises a plastic material, preferably polycarbonate, wherein the first image area is opaque and the second image area is transparent.

The substrate comprises two different areas which are easily distinguishable, due to the fact that one of the areas is opaque and the other area is transparent. The opaque area may comprise a first image such as a two-dimensional or three-dimensional portrait. The transparent window comprises a second image which is superposed on the underlying third image that is formed by projection through the transparent window. This provides an easy recognition of the correspondence of the second and third image and of the first and second image without the need of further action by the user or inspecting person, by means of the transparent window, which is immediately recognizable and easy to teach to anyone verifying identity documents.

It has been found that by having the second image area being transparent, the infrared light transmission through said area is about 90-94%, while the about 6-10% of the infrared light will be reflected off from the front surface of the second image area or from the inside of the back surface of the second image area.

Moreover, the second image area is made of transparent material, being said material the same as the rest of the substrate, while the rest of the substrate or at least the second image area is opaque. The infrared transmittance of the transparent second image area near-infrared energy is in the region between 700-2800 nm. This provides the possibility to laser provide underlying third image through the transparent window, wherein the second image area is located. It should be noted that, the opaque first image area may not allow transmittance of infrared light through it.

According to the invention, the second image area comprises a laser removable material such as a metal layer.

In this way, the fraudulent duplication of the identity document becomes even more difficult, and at the same time, this can make very easy to recognize the laser engraved image due to the fact that the laser removable material will be only removed in the point where the laser has been applied, leaving a pattern in the second image area easily recognizable by simple visual inspection. This can be verified by the bare eye and does not require any special lighting.

The second laser engraved image may correspond to the first image. Moreover, the first image could be a portrait of a human face.

In an embodiment of the present invention, the adjacent surface comprises a laser sensitive material which produces a visible pattern when irradiated by a laser. It should be noted that the laser sensitive material may comprise an ink.

As a result, the quality of the third image formed onto the adjacent surface is increased. Moreover, the risk of the unique characteristics of the image being lost through specific absorption particulars of the adjacent surface or excess energy absorption resulting in formation of gaseous products are substantially reduced.

According to an embodiment, the second laser produced image is formed by laser engraving and the amount of the laser energy absorbed by the adjacent surface is at least 10 times higher than the amount of laser energy absorbed in the second image area. Alternatively, the second laser produced image is formed by laser ablation or perforation and the amount of laser energy absorbed by the adjacent surface is at least 10 times lower than the amount of laser energy absorbed in the second image area.

The adjacent surface can be over-exposed to the laser energy, by means of absorbing about 90% of the laser energy when laser engraving the third image onto the second image are and simultaneously on the underlying adjacent surface. Alternatively, the adjacent surface can be under exposed to the laser energy, by means of absorbing about 10% of the laser energy when laser ablating or perforating the second image area which simultaneously laser engraving the third image onto the adjacent surface.

In a preferred embodiment of the invention, the second image area may comprise openings that form a defined pattern, e.g. a portrait of a human face or data.

Advantageously, when the third image is provided through the second image area, the adjacent surface may need to be tuned by implementing the laser sensitive material depending on the intensity to the laser beam.

In this way, the temperature of the adjacent surface while the third image is engraved remains sufficiently low to avoid heat damage in said adjacent surface, thus preventing blurring burning effects.

In a preferred embodiment of the invention, the thickness of the substrate comprising plastic material is about 300-900 μm.

It should be noted that the thickness of the substrate is to be the same over its entire area.

Furthermore, the invention relates to a method for producing an identification assembly of any of the preceding claims, wherein the method comprises the following steps:

providing a substrate comprising at least two image areas;

providing an adjacent surface to said substrate, attaching the substrate to the adjacent surface in a hinging manner, laser producing a first image in a first image area without laser energy being transferred to the adjacent surface;

laser producing a second image onto a second image area while allowing part of the laser energy to penetrate through the substrate and to form an image in the adjacent surface.

In other words, the third image is provided while the second image is laser engraved, so that the adjacent surface is radiated by the laser when engraving the second image, as to create the third image.

The method according to the invention provides an identity document producing three images in different surfaces in a simple and efficient manner, and being cost effective. Moreover, the third image is used as a further identification feature, which will remain when the substrate page is entirely exchanged for fraudulent use of the identity document. Thus, indicating to the inspecting person that the substrate has been manipulated.

According to an embodiment the method further comprises providing a laser-sensitive material onto the adjacent surface providing a visible coloration when impinged by laser energy. Examples of such a laser sensitive material will be provided in the detailed description below.

Furthermore, the method also comprises the fact that the laser energy is adapted as to provide a visible image in the second image area and onto the adjacent surface without pyrolysis gases forming in a third image area, having a negative effect on the image definition and possibly condensing against the holder page thereby reducing the image or image definition.

In this way, when laser engraving the second image no pyrolysis gases forming onto the third image area, which could damage the substrate and/or the adjacent surface or blur the images formed.

It has been found that by having an optically variable ink on a black ink layer applied onto the adjacent surface, those inks can be off-set printed and screen printed respectively. These inks can provide an optic variable effect when applied onto the adjacent surface when the third image corresponding to the second image is provided through the second image area of the substrate. In this manner, a simple identification feature, with a positive image is provided which makes it very difficult to exchange the substrate part from the identity document and at the same time allows easy visual inspection by the user and/or an inspecting person. An illustrate example of a black offset ink includes, but is not limited to, the commercially available Sipca black ink number 367022W, while an example of the optically variable ink includes, but is not limited to, the commercially available Luminescence purple to blue Sec+ optically variable SB.

In summary, it will be seen that the present invention provides a method which offers an identification assembly with improved features allowing easy authentication and verification of an identity document, while preventing fraudulent exchange of any of the parts of said identity document, and improving the link between the identity document parts.

BRIEF DESCRIPTION OF THE DRAWINGS

Other aspects, features and details of the present invention will be readily understood by reference to the following detailed description of preferred embodiments, taken in conjunction with the drawings.

In the appended drawings.

DETAILED DESCRIPTION OF THE EMBODIMENTS

Figure 1:
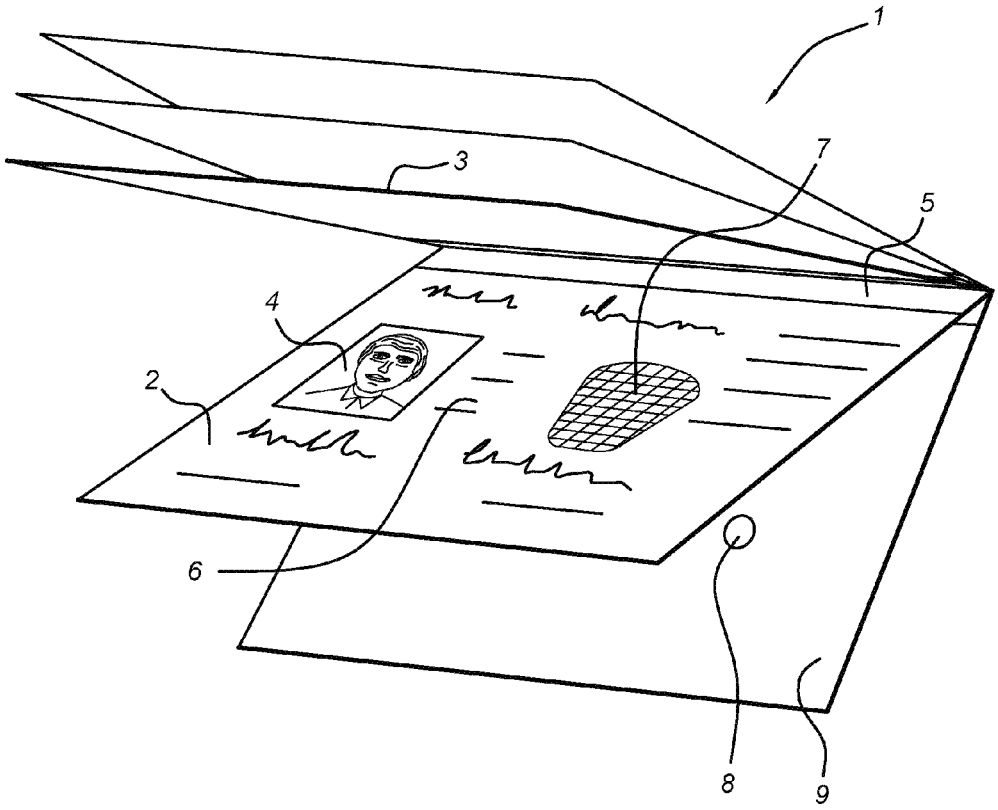
Fig. 1 Prior art
FIG. 1 shows diagrammatically an identity document according to the prior art.

FIG. 1 shows an identity document, in a form of a book-like construction such as a passport according to the prior art, as indicated by 1 in FIG. 1. This construction is composed of a cover 9 in which a number of visa pages 3 are accommodated. A substrate, or so-called holder page 2 made of a relatively stiff, non-deformable polycarbonate material is also included. An example of such a non-deformable polycarbonate material is a polycarbonate material with a thickness between 300 and 900 μm. A number of security features are provided, including a first image area comprising an image 4 of a face of the passport holder, as well as data 6 and a transparent window 7. In the most adjacent of the visa pages 3, a mark 8 is provided and which can be seen through the transparent window 7 when the holder page 2 is hinged close as to overlap the visa pages 3.

Moreover, a hinged part 5 is fixed to the holder page 2, as can be seen from FIG. 1. This hinged part 5 can be connected both to the cover 9 and to the visa pages 3. The connecting technique can comprise sewing, stapling, gluing and the like.

Figure 2A:
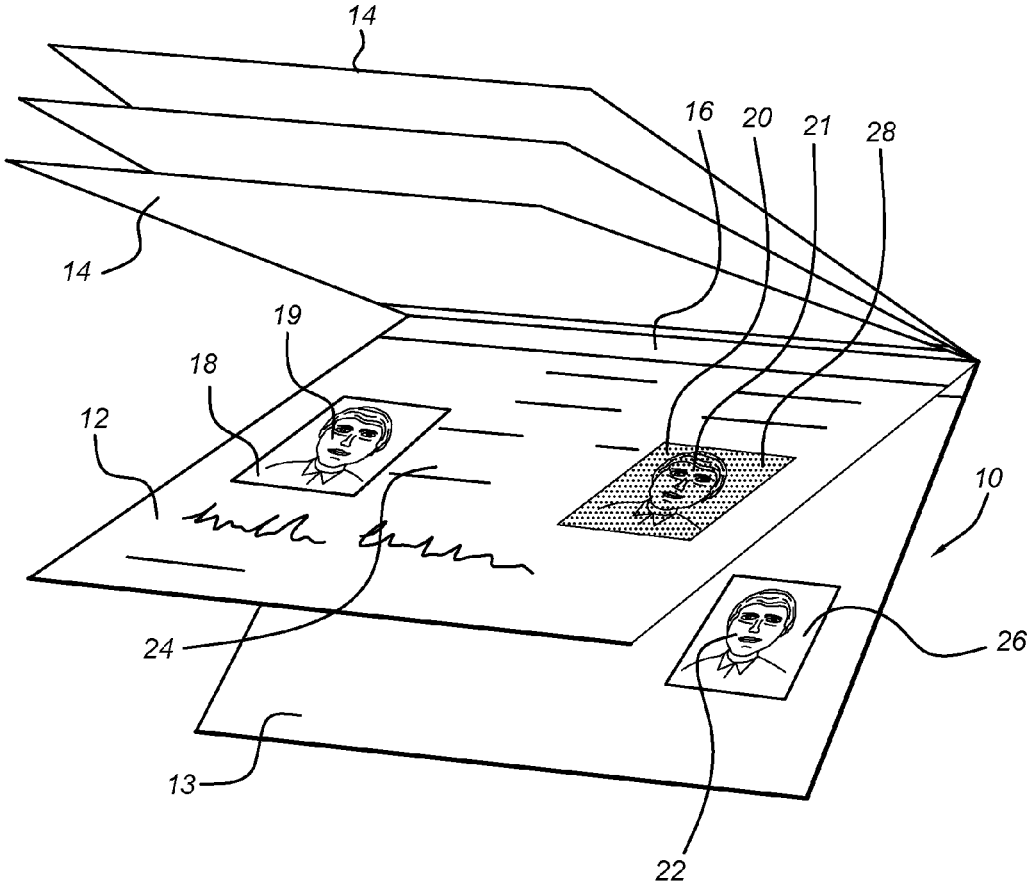
FIG. 2*a* shows diagrammatically an identity document according to the invention.

FIG. 2*a* shows an identity document 10 according to the invention, in a form of a book-like construction such as a passport. The passport 10 comprises a substrate 12, hereafter referred as holder page, made of a relatively stiff, non-deformable material such as polycarbonate material. Moreover, the passport 10 comprises an adjacent surface 13, hereafter referred as a cover, and subsequent pages 14 on the opposite side of the cover page 13, hereafter referred as visa pages. A hinged part 16 is fixed to the holder page 12 and can be also connected both to the cover 13 and to the visa pages 14.

The holder page 12 comprises a first image area 18 having a first image 19 of a face of the passport holder. The holder page further comprises data 24 corresponding to personal data of passport holder, and a second transparent image area 20 having a second laser produced image 21.

It should be noted that the second image area 20 is a transparent area or window and allows viewing of the underlying surface 13 through the window 20. The cover page 13 as here represented is provided with a third image 22 which overlaps with the second produced image 21 when the holder page 12 is hinged close as to overlap the cover page 13. The third image 22 is visible to the inspecting person by lifting the holder page 12 away from said cover page 13, as clearly seen in FIG. 2*a*.

It will be appreciated that the first image 19 is an image of the face of the passport holder. Thus, it should be noted that the second laser produced image 21 corresponds to the same image as the first image 19. Moreover, the third image 22 is provided through the second image area 20 as it will be explained in detail here below.

Figure 2B:
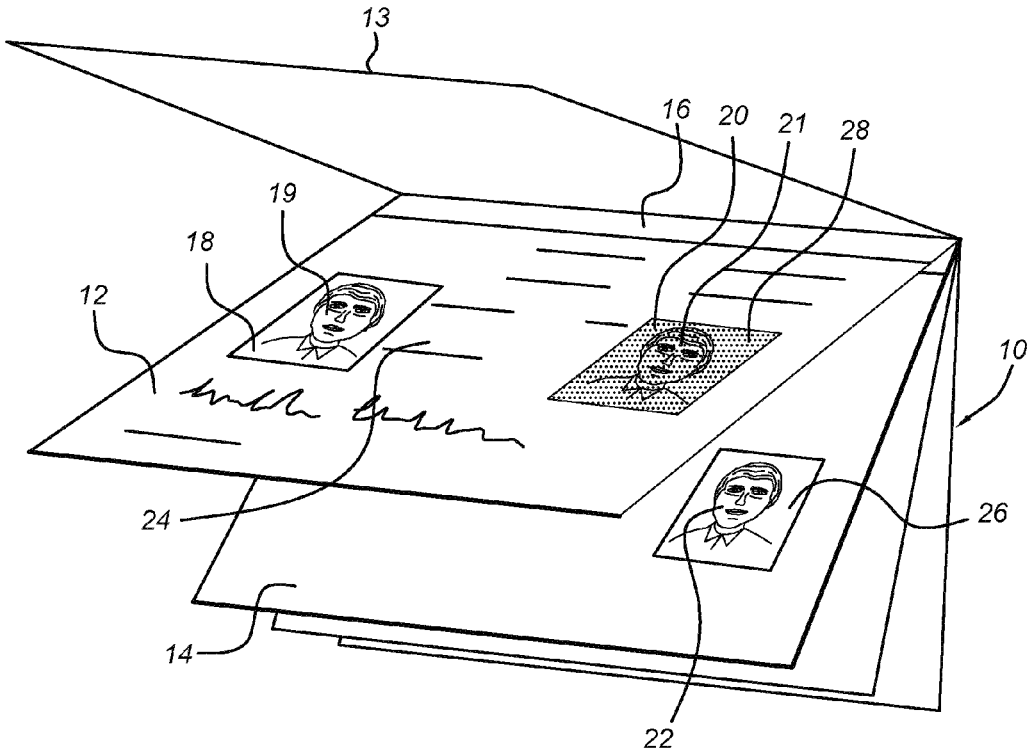
FIG. 2*b* shows diagrammatically an identity document according to a further embodiment of the invention.

FIG. 2*b* shows a different embodiment of the invention where the most adjacent surface 14 and subsequent pages are the visa pages. The second image area 20 is the transparent area or window and allows viewing of the underlying surface 14 through the window 20. The most adjacent of the visa pages 14 is provided with the third image 22 which overlaps with the second image 21 when the holder page 12 is hinged close as to overlap the visa pages 14. The third image 22 is visible to the inspecting person by lifting the holder page 12 away from said adjacent visa pages 14, as here illustrated.

Figure 3:
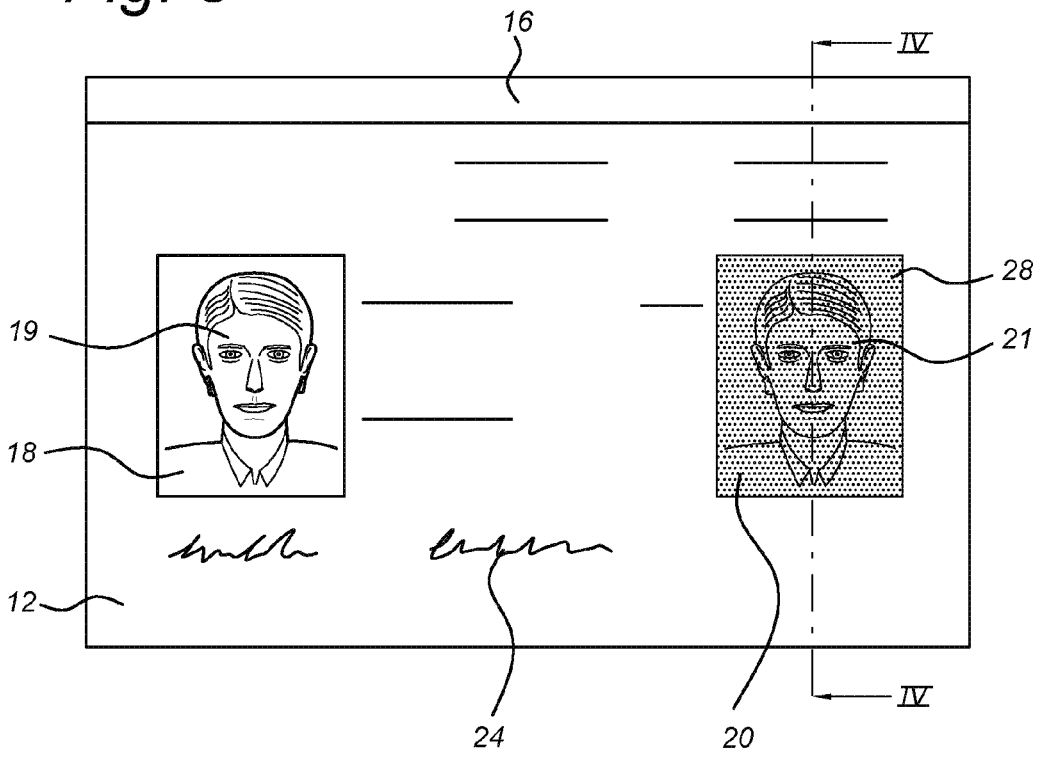
FIG. 3 shows a front view of a substrate of the identity document according to the invention including a hinged part.

In FIG. 3 a front view of the holder page of the identity document according to the invention including a hinged part is shown. It can be seen that the second laser produced image 21 is the same image as the first 19, which correspond to a portrait of a human face. The hinged part 16 is preferably attached to the holder page 12 by fusing or any other suitable technique. It should be understood that the hinged part 16 can be made of a different material than the holder page 12.

The second image 21 is located at the transparent area 20 as it can be clearly seen in FIG. 3. The transparent area 20 allows the user to partially see the cover page 13, and that this will prompt the user to check the cover page 13.

It should be noted that the second image area 20 could further comprise laser engraved digits and/or letters (not illustrated). Moreover, the holder page 12 could also comprise under a series of cylindrical lenses forming a lens array, a further image based on the first image 19 (not illustrated).

Figure 4:
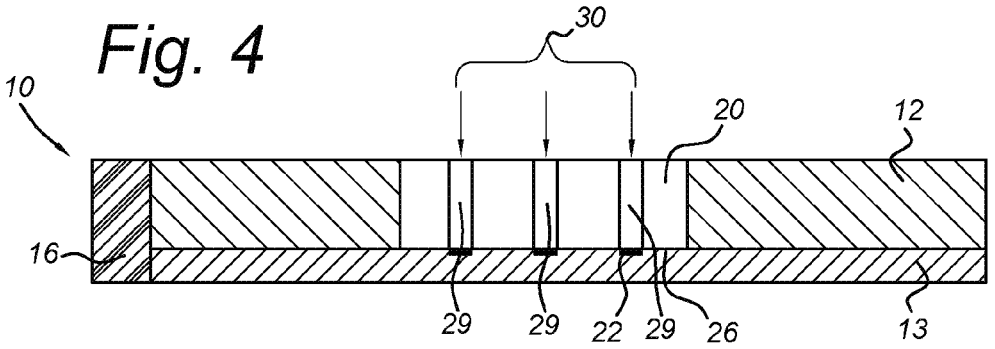
FIG. 4 shows a transverse cross section of the substrate showing a second image area and an adjacent surface of FIG. 3 along the line IV-IV.

FIG. 4 illustrates a transverse cross section of the holder page 12 showing the second image area 20 and the adjacent cover page 13 of FIG. 3 along the line IV-IV, wherein the second image 21 is applied onto the second image area 20 by laser engraving in said area by a laser beam 30. The laser beam 30 irradiates and passes through the inside of the second image area 20 while providing blackened regions that form the second image 21 is said area 20. Moreover, the laser beam 30 irradiates the adjacent cover page 13 as to activate a laser sensitive material 26 which is applied on or contained by the adjacent cover page 13. In this way, the third image 22 in the adjacent visa page 14 is provided.

When the laser beam 30 irradiates the second image area 20, a number of lines m lines or dots per cm is engraved as to create the second image 21. The number of m lines or dots per cm may be between 40 and 600 lines or about 200-250 dots/cm. By laser engraving the second image 21, the third image 22 is simultaneously engraved onto the adjacent cover page 13, by the laser beam 30, upon touching the surface of the adjacent cover page 13 containing the laser sensitive material 26. This energy is delivered by the laser beam 30 changes the surface of the material 26 under the focal point. The surface of the adjacent cover page 13 and consequently the material 26 may heat up and subsequently vaporize the material 26 in those points where the laser beam 30 irradiates. This is undesired and may lead to the formation of pyrolysis gaseous products. Special laser sensitive material incorporating optically variable silicate or other materials which change their optically effect may be used to create an image corresponding to the third image 22. An example of the material 26 applied onto one of the surfaces of the second image area 20 of the substrate 12 or alternatively to the adjacent surface 13, 14 is an optically variable ink on a black ink layer.

It should be noted that depending on the nature of the laser sensitive material 26, the image created when the laser beam 30 irradiates this material will be a single or multicolour coloured imaged, but can also be a positive or negative image.

Moreover, it will be appreciated that the laser beam 30 irradiates the holder page very efficiently because the laser beam can be designed to deliver energy to the holder page in a manner which converts a high percentage of the light energy into heat. This could lead to gases forming between the lower surface of the second image area 20 and the adjacent visa page 14 where the third image 22 will be provided. In order to avoid such gases from forming, the laser energy is adapted to avoid formation of gases that could difficult the formation of the third image 22. Additionally, the formulation of the substrate material can be adapted in order to avoid the formation of such gases, by adding a stable (non-flammable) material, such as silicates.

Figure 5:
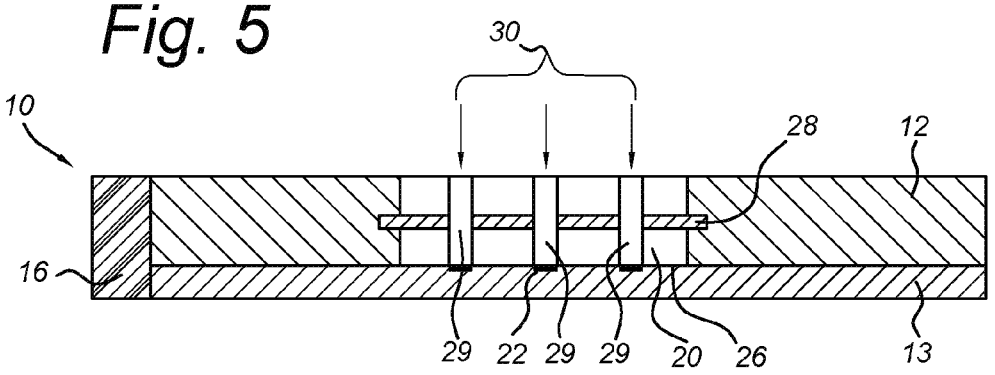
FIG. 5 shows a transverse cross section of the substrate showing a second image area and an adjacent surface of FIG. 3 along the line IV-IV of a different embodiment of the identity document according to the present invention.

FIG. 5 illustrates a different embodiment of the identity document according to the present invention wherein the second image area 20 further comprises a laser meltable material 28, such as a metal layer. The metal layer 28 is melted where the laser beam 30 irradiates the second image area 20. The melted metal forms into small globules that causes transparency in openings 29 in the metal layer 28. This provides a further feature on the holder page 12, for making more difficult the fraudulent used and copy of the passport.

As it will be appreciated from FIG. 5, the metal layer 28 has been partially melted in those parts of the second image area 20 surface into which the laser beam 30 have penetrated said image area 20. In this way, a pattern is created in a form of an image of the passport holder. This means that the metal layer 28 is selectively melted leaving transparent areas. The resulting image in the second image area 20 can be seen in the transmitted light as a positive or negative half-tone picture.

The metal layer 28 as seen in FIG. 5 is positioned in the substrate, crossing the entire area of the second image area 20. It should be noted that the metal layer 28 can also be provided on the surface of the substrate 12 second image area, thus when the laser beam 30 irradiates the second image area 20, the metal layer 28 is partially removed in those parts of the surface of the second image area 20 into which the laser beam 30 irradiates.

In the light of the above, variants will be immediately apparent to those skilled in the art that are obvious in the light of he above description and fall within the scope of the appended claims.

The invention claimed is:

1. A method for producing an identification assembly, wherein the method comprises the following steps:

providing a substrate (12) comprising at least two image areas (18, 20);

providing an adjacent surface (13, 14) to said substrate (12), attaching the substrate (12) to the adjacent surface (13, 14) in a hinging manner, laser producing a first image (19) in a first image area (18) without laser energy being transferred to the adjacent surface (13, 14);

laser producing a second image (21) onto a second image area (20) while allowing part of the laser energy to penetrate through the substrate (12) and to form a third image (22) in the adjacent surface (13, 14), wherein the third image is (20) opaque and the second image is (20) transparent.

2. Method according to claim 1, providing a laser-sensitive material onto the adjacent surface (14) providing a visible coloration when imprinted by laser energy.

3. Method according to claim 1, wherein the laser energy is adapted as to provide a visible image in the second image area (20) and onto the adjacent surface (13, 14) without pyrolysis gases forming in a third image area.

* * * * *